US008127654B2

(12) United States Patent
Williams et al.

(10) Patent No.: US 8,127,654 B2
(45) Date of Patent: Mar. 6, 2012

(54) PERFORATING GUNS WITH REDUCED INTERNAL VOLUME

(75) Inventors: Harvey Williams, Houston, TX (US); Lawrence A. Behrmann, Houston, TX (US); Jerry D. Campbell, Katy, TX (US); Ronald Lutz, Deer Park, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 104 days.

(21) Appl. No.: 12/650,331

(22) Filed: Dec. 30, 2009

(65) Prior Publication Data

US 2010/0319520 A1 Dec. 23, 2010

Related U.S. Application Data

(60) Provisional application No. 61/187,858, filed on Jun. 17, 2009.

(51) Int. Cl.
*E21B 43/116* (2006.01)

(52) U.S. Cl. ..... 89/1.151; 89/1.15; 102/313

(58) Field of Classification Search ..... 89/1.15, 89/1.151; 102/306, 310–314, 320–321.1; 166/55, 55.1, 55.2, 63, 297–299; 175/4.5, 175/4.51, 4.57, 4.6

See application file for complete search history.

(56) References Cited

U.S. PATENT DOCUMENTS

| | | | | |
|---|---|---|---|---|
| 2,980,017 | A * | 4/1961 | Castel | 175/4.6 |
| 3,209,650 | A * | 10/1965 | Andrew | 175/3.5 |
| 4,191,265 | A * | 3/1980 | Bosse-Platiere | 175/4.56 |
| 5,673,760 | A * | 10/1997 | Brooks et al. | 175/4.6 |
| 6,386,109 | B1 * | 5/2002 | Brooks et al. | 102/306 |
| 6,520,258 | B1 * | 2/2003 | Yang et al. | 166/297 |
| 6,554,081 | B1 * | 4/2003 | Brooks et al. | 175/4.54 |
| 6,732,798 | B2 * | 5/2004 | Johnson et al. | 166/297 |
| 6,865,792 | B2 * | 3/2005 | Kash | 29/455.1 |
| 6,874,579 | B2 * | 4/2005 | Johnson et al. | 166/298 |
| 6,896,059 | B2 * | 5/2005 | Brooks et al. | 166/297 |
| 6,966,377 | B2 * | 11/2005 | Johnson et al. | 166/297 |
| 7,360,587 | B2 * | 4/2008 | Walker et al. | 166/55.1 |
| 7,451,819 | B2 * | 11/2008 | Chang et al. | 166/299 |
| 7,845,410 | B2 * | 12/2010 | Chang et al. | 166/297 |
| 2003/0089498 | A1 * | 5/2003 | Johnson et al. | 166/297 |
| 2003/0150646 | A1 * | 8/2003 | Brooks et al. | 175/2 |
| 2004/0159432 | A1 * | 8/2004 | Johnson et al. | 166/297 |
| 2004/0159434 | A1 * | 8/2004 | Johnson et al. | 166/311 |
| 2005/0167108 | A1 * | 8/2005 | Chang et al. | 166/298 |
| 2009/0032258 | A1 * | 2/2009 | Chang et al. | 166/299 |
| 2010/0044044 | A1 * | 2/2010 | Johnson et al. | 166/297 |
| 2011/0042089 | A1 * | 2/2011 | Chang et al. | 166/297 |

* cited by examiner

*Primary Examiner* — Michael Carone
*Assistant Examiner* — Jonathan C Weber
(74) *Attorney, Agent, or Firm* — Chadwick A. Sullivan; Rodney Warfford

(57) ABSTRACT

A perforating device has an elongated tubular housing and a loading device supporting a plurality of shaped charges. The loading device and the shaped charges are located inside the housing. A volume reduction device is adapted to fit within the loading device and to conform to the profile of the shaped charges thereby filling open volume in the housing.

17 Claims, 1 Drawing Sheet

PERFORATING GUNS WITH REDUCED INTERNAL VOLUME

PRIORITY

The present application claims priority to U.S. Provisional Application No. 61/187,858 that was filed on Jun. 17, 2009, the entirety of which is incorporated herein by reference.

TECHNICAL FIELD

The present application relates generally to perforating and more specifically to perforating guns having a volume reduction device that conforms to the profile of shaped charges to reduce internal gun volume and to help support the shaped charges.

BACKGROUND

To complete a well, one or more formation zones adjacent a wellbore are perforated to allow fluid from the formation zones to flow into the well for production to the surface or to allow injection fluids to be applied into the formation zones. A perforating gun string may be lowered into the well and the guns fired to create openings in casing and to extend perforations into the surrounding formation.

When the shaped charge is detonated a portion of the liner forms a jet portion of the liner. The jet is propelled away from the jacket in a direction toward a target. Another portion of the liner is propelled away from the jacket and forms what is known as a slug or carrot portion of the liner. The slug or carrot portion is not propelled to the same extent as the "jet". When the shaped charge is used in a perforating gun, the target is normally a cased downhole formation. Upon detonation, the jet portion of the liner is propelled through the casing and penetrates the downhole formation to enhance recovery of downhole hydrocarbons. The slug portion, on the other hand, is designed to break up upon contact with the casing.

The explosive nature of the formation of perforation tunnels shatters sand grains of the formation. A layer of "shock damaged region" having a permeability lower than that of the virgin formation matrix may be formed around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties, and so forth. The shock damaged region and loose debris in the perforation tunnels may impair the productivity of production wells or the injectivity of injector wells.

In connection with those and other issues, there is continued need to improve the overall performance of perforating and perforating guns in many aspects. The present application addresses a number of present needs in that area.

SUMMARY

An embodiment according to the present application includes a perforating device. The perforating device has an elongated tubular housing and a loading device supporting a plurality of shaped charges. The loading device and the shaped charges are located inside the housing. A volume reduction device is adapted to fit with the loading device and to conform to the profile of the shaped charges thereby filling open volume in the housing.

BRIEF DESCRIPTION OF THE FIGURES

The following is a brief description of drawings relating to various embodiments of the present application.

DETAILED DESCRIPTION

Figure 1:
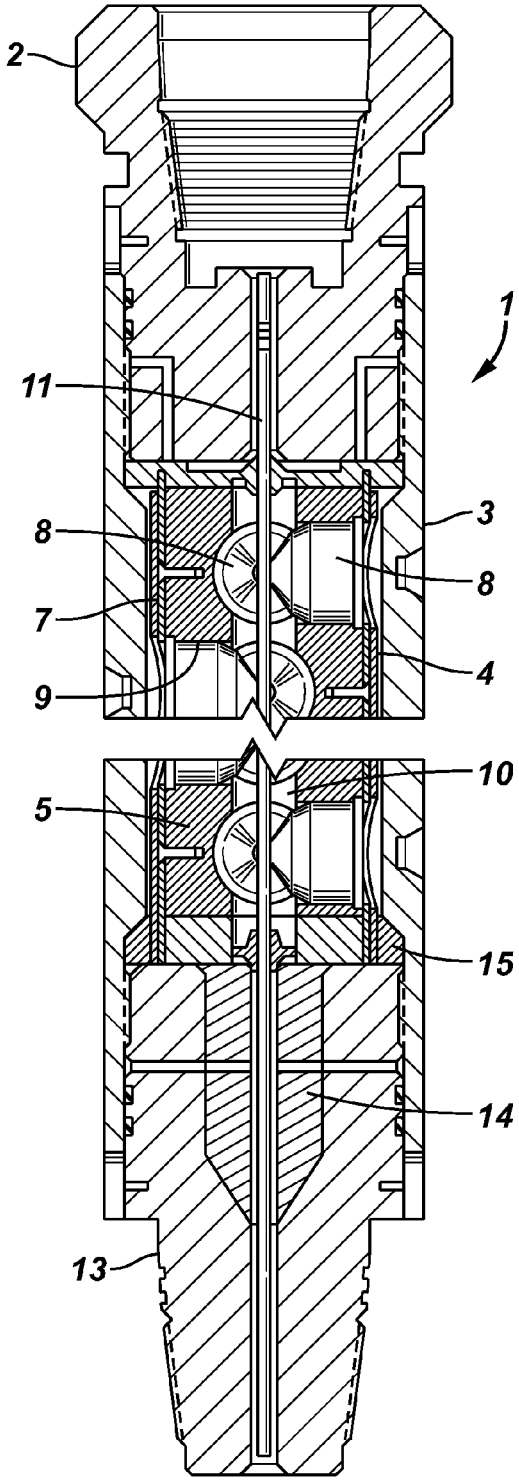
FIG. 1 shows a side cross sectional view of an embodiment.

In the present description, numerous details are set forth to provide an understanding of the various embodiments. However, it will be understood by those skilled in the art that those embodiments presented may be practiced without many details and that numerous variations or modifications from the described embodiments may be possible.

In the specification and appended claims, the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and "downwardly", "upstream" and "downstream"; "above" and "below"; and other like terms indicating relative positions above or below a given point or element are used in this description to more clearly described some embodiments.

A typical shaped charge has a metal jacket or a charge case. High explosive material is disposed inside the metal jacket. A liner retains the explosive material in the jacket during the period prior to detonation. A primer column provides a detonating link between a detonating cord and the explosive.

Overbalance and underbalance are significant factors in successful perforating jobs. One popular method of obtaining clean perforations is underbalanced perforating. A perforation carried out with a lower wellbore pressure than the formation pressure is underbalanced. The pressure equalization is achieved by fluid flow from the formation and into the wellbore. This fluid flow carries some of the damaging rock particles. However, underbalance perforating may not always be effective and may be expensive and unsafe to implement in certain downhole conditions.

Fracturing of the formation to bypass the damaged and plugged perforation may be another option. However, fracturing is a relatively expensive operation. Moreover, clean, undamaged perforations are required for low fracture initiation pressure (one of the pre-conditions for a good fracturing job).

Acidizing, another widely used method for removing perforation damage, is not most effective for treating sand and loose debris left inside the perforation tunnel.

During the detonation of perforating guns in a wellbore, fluid pressure transients are produced due to local and global differences in pressure between the gun, wellbore and fluid in the reservoir. These pressure transients can give rise to both underbalance and overbalance conditions in the wellbore. U.S. Pat. No. 6,732,798, incorporated herein by reference in its entirety, describes methods for controlling an underbalance in a wellbore.

Perforating guns generally include a housing that is tubular in shape and forms an outer barrier of the perforating gun. Shaped charges are located inside the housing. The shaped charges are generally loaded into and/or supported by a loading device, often referred to as a "loading tube". The loading device can take many forms. The loading device can be a central longitudinal structure where the shaped charges are connected thereto. The loading device can be a flat plate where the shaped charges are supported against the plate. The flat plate can be instead formed with a helical twist having the shaped charges connected thereto. Also, the loading device can be in the shape of a tube having openings for placement and support of the shaped charges. An additional internal structure can be part of the tube shaped loading device to support the apex portion of the shaped charges.

The present application relates to modification of a perforating gun system to help control (e.g., reduce) underbalance conditions that would normally be produced by a perforating gun with a housing, a loading device and shaped charges supported by the loading device. According to the present application, a modification that reduces underbalance conditions is the additional inclusion into a perforating gun of a volume reduction device. The volume reduction device can be adapted to conform to the external profile of the shaped charges thereby taking up free internal gun volume while supporting the shaped charges. The volume reduction device can be adapted to conform to the internal shape of a tubular shaped loading device. If the loading device is central in style or a plate, then the volume reduction device can be adapted to conform to the shape of the housing. Further, the volume reduction device can conform to the profile of the shaped charges.

In an embodiment, gun pressure is controlled by the balance of total explosive mass inside the gun to free internal volume in the gun. To make a PURE (underbalanced) design, reduction of gun pressure is used, i.e., the ratio of total explosive mass to free internal volume is decreased. However, in some perforating job designs (PURE and non-PURE) it is needed to increase the gun pressure, i.e., increase the ratio of total explosive mass inside the gun to free internal volume in the gun.

A benefit according to present embodiments is reduction of underpressure. According to the present application, free volume in the perforating gun is reduced beyond the volumes normally displaced by the loading device, and shaped charges by adding the volume reduction device. The internal gun volume can be reduced to an even greater degree by adding more components inside the gun, e.g., by adding loading tube volume reduction sleeve(s), thread relief volume reduction insert(s), and/or adapter volume reduction insert(s). FIG. 1 shows an embodiment of a perforating device having a number of these features.

Another benefit of present embodiments relates to low debris perforating. The volume reduction device contributes to low shaped charge case debris by supporting and conforming to the shape of each of a plurality of shaped charges inside the loading tube insert assembly. When detonation occurs, the shaped charge case(s) are inclined to remain intact due to containment provided by the volume reduction device fitting around the shaped charges. Hence, the loading tube insert assembly reduces the amount of shaped charge case debris that could potentially exit from the perforating gun and into the well.

FIG. 1 shows a side cross-sectional view of a perforating gun according to various embodiments. A perforating gun 1 is shown having a firing head 2 that connects with a tubular housing 3. A loading device 7 that is tubular is located within the housing 3 and supports shaped charges 8. The tubular loading device 7 has openings where the shaped charges 8 fit and are supported. A loading tube volume reduction sleeve 4 can be located outside of the loading tube 7 and takes up excess space between the loading tube 7 and the inside of the housing 3. The volume reduction sleeve 4 has openings that correspond to the shaped charges 8. The thickness of the volume reduction sleeve 4 can be varied depending on the precise tolerance required.

A volume reduction device 5 is located inside the loading tube 7 and is configured to fit around and conform to the shaped charges 8. FIG. 1 shows an embodiment where the volume reduction device 5 is a single uniform part that extends from the top of the loading tube 7 to the bottom of the loading tube 7, thereby fitting around a plurality of shaped charges 8 that are located inside the loading tube 7.

Figure 2:
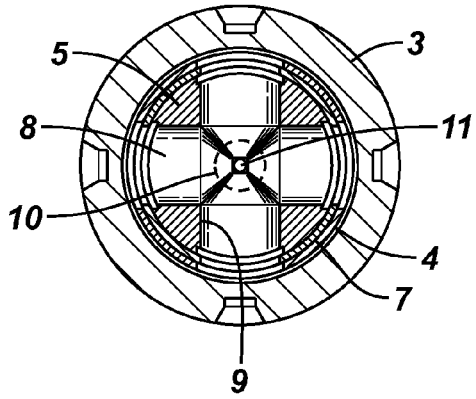
FIG. 2 shows an axial cross sectional view of the embodiment shown in FIG. 1.

The shaped charges 8 can be configured in a number of patterns. FIGS. 1 and 2 show sets of four shaped charges 8 that are at the same distance longitudinally along the loading tube 7 evenly spaced/angled radially around the axis of the loading tube 7. Alternatively, the shaped charges 8 could be arranged in a helical pattern. The sets of shaped charges 8 could be in a pattern of three at the same distance longitudinally along the loading tube spaced radially about the axis of the loading tube 7. The shaped charges 8 could also be on one side of the gun or the other in a sequential line in the axial direction.

The assembly shown in FIGS. 1 and 2 is assembled as follows. First, the volume reduction device 5 along with a detonation cord are placed inside the loading tube 7. The volume reduction part 5 has indentations that are configured to conform to the shape of the shaped charges 8. Once the volume reduction device 5 is located in the loading tube 7, the shaped charges 8 are placed into the loading tube 7 via openings in the loading tube 7 that conform to the openings in the volume reduction part 5 that conform to the shape of the shaped charges 8.

In an embodiment the volume reduction device 5 is a tubular part with a hollow central passage 10 that extends the entire longitudinal distance of the volume reduction device 5. Openings 9 extend from the surface of the volume reduction part 5 near the inner part of the loading tube 7 to the hollow center passage 10. A detonation cord 11 extends though the hollow center passage 10.

In an embodiment, the volume reduction device 5 can be a single unified part that extends from the top part of the loading tube 7 to the bottom part of the loading tube 7. In that case, the single volume reduction device 7 conforms to and surrounds plural shaped charges 8.

In an embodiment, the volume reduction device 5 can be made from plural parts that are each tubular in shape and have plural indentations that are adapted to conform to the shape of shaped charges 8. Each of those parts that make up the volume reduction device 5 has a cavity 10 extending through the center of the volume reduction device 5 to accommodate a detonation cord 11.

An embodiment includes a volume reduction part 5 that has two halves separated longitudinally. This configuration helps simplify construction of the volume reduction part 5 as internal milling or molding is not required.

An embodiment includes a volume reduction device 5 that is made from a plurality of parts that together make up a volume reduction device 5 that conforms to and surrounds plural shaped charges 8 that are located inside a perforating gun 1.

A bottom plug 13 can be connected with the lower part of the housing 3. Inserts 14 can be made in connection with the bottom plug 13 that takes up additional volume thereby increasing the underbalance reduction. Volume reduction thread inserts 15 can also be used to take up additional space.

The volume reduction device 5 is preferably made from metal. However, the volume reduction device 5 could be made from other materials such as ceramics and or composite materials, so long as they can adequately survive the perforating operation.

Accordingly, although only a few embodiments have been described in detail above, those of ordinary skill in the art will readily appreciate that many modifications are possible without materially departing from the teachings of this application. The description of various preferred embodiments and related features herein is not meant in any way to unduly limit the scope of any claims related to the present application.

What is claimed is:

1. A method of perforating a wellbore, the method comprising:

providing a perforating gun having a tubular housing and shaped charges therein;

selecting a desired resultant transient pressure condition at a location in the well bore;

calculating a ratio of total explosive mass to free internal volume in the perforating gun that will achieve the desired resultant pressure condition in the well bore;

selecting a volume reduction device adapted to fit within the housing and conform to outer profiles of the shaped charges to thereby achieve the ratio of total explosive mass to free internal volume in the perforating gun; and inserting the volume reduction device into the tubular housing.

2. A method according to claim 1, comprising calculating the ratio of total explosive mass to free internal volume in the perforating gun based upon at least wellbore fluid pressure, gun detonation pressure, charge type, and perforating gun configuration.

3. A method according to claim 1, comprising inserting the perforating gun into the wellbore and detonating the shaped charges to achieve the desired resultant pressure condition in the well.

4. A method according to claim 1, comprising selecting one or more additional components for insertion into the perforating gun to further reduce the internal gun volume.

5. A method according to claim 4, wherein the one or more additional components comprise a volume reduction sleeve.

6. A method according to claim 1, comprising selecting a volume reduction device that is a single unified part having a plurality of openings therein to accept a plurality of shaped charges.

7. A method according to claim 1, comprising selecting a volume reduction device that comprises two separate parts, each part being tubular in shape and each part being located adjacent to one another end to end.

8. A method according to claim 1, comprising selecting a volume reduction device that comprises two separate halves that come together along a longitudinally extending plane to together form the volume reduction device.

9. A method of assembling a perforated gun system, the method comprising:

identifying a target underbalance condition at a location in a well bore;

assembling a perforating gun to achieve the target underbalance condition at the location in a well bore by (a) determining a total explosive mass of one or more shaped charges in the perforating gun;

(b) calculating a ratio of total explosive mass to free internal volume of the perforating gun that will achieve the target underbalance condition;

(c) selecting one or more volume reduction devices to achieve the free internal volume of the perforating gun, thereby increasing the ratio of total explosive mass to free internal volume of the perforating gun; and (d) inserting the selected volume reduction devices into the perforating gun.

10. A method according to claim 9, comprising generating the target underbalance condition at the location in the wellbore by activating the perforating gun.

11. The method of claim 9, further comprising providing a loading device in the perforating gun, the loading device having a plurality of openings for accepting and supporting the shaped charges.

12. The method of claim 11, wherein the volume reduction device comprises a plurality of openings to accept the shaped charges.

13. The method of claim 12, further comprising locating the volume reduction device inside the loading device and aligning the openings in the volume reduction device and the openings in the loading device.

14. The method of claim 12, further comprising locating a volume reduction sleeve on an outside surface of the loading device, wherein the volume reduction sleeve has openings that are adjacent to and correspond to the openings in the loading device and in the volume reduction device.

15. The method of claim 12, wherein the volume reduction device is a single unified part.

16. The method of claim 12, wherein the volume reduction device is made of two separate parts, each part being tubular in shape and each part being located adjacent to one another end to end.

17. The method of claim 12, wherein the volume reduction device is made of two separate halves, each half being crescent-shaped and each part coming together along a longitudinally extending plane.

* * * * *